US008638272B2

(12) United States Patent
Tanabe et al.

(10) Patent No.: US 8,638,272 B2
(45) Date of Patent: Jan. 28, 2014

(54) ARRAY ANTENNA AND METHOD FOR MANUFACUTRING ARRAY ANTENNA

(75) Inventors: Kosuke Tanabe, Tokyo (JP); Atsushi Ooshima, Tokyo (JP)

(73) Assignee: NEC Corporation, Tokyo (JP)

( * ) Notice: Subject to any disclaimer, the term of this patent is extended or adjusted under 35 U.S.C. 154(b) by 124 days.

(21) Appl. No.: 13/144,830

(22) PCT Filed: Dec. 22, 2009

(86) PCT No.: PCT/JP2009/071311
§ 371 (c)(1),
(2), (4) Date: Jul. 15, 2011

(87) PCT Pub. No.: WO2010/089941
PCT Pub. Date: Aug. 12, 2010

(65) Prior Publication Data

US 2011/0279345 A1 Nov. 17, 2011

(30) Foreign Application Priority Data

Feb. 5, 2009 (JP) ..... 2009-025232

(51) Int. Cl.
*H01Q 21/00* (2006.01)

(52) U.S. Cl.
USPC ..... 343/853; 343/754

(58) Field of Classification Search
USPC ..... 343/754, 853
See application file for complete search history.

(56) References Cited

U.S. PATENT DOCUMENTS

| | | | | |
|---|---|---|---|---|
| 7,405,695 | B2 * | 7/2008 | Liu | 342/374 |
| 7,639,994 | B2 * | 12/2009 | Greene et al. | 455/129 |
| 2004/0061654 | A1 * | 4/2004 | Webb et al. | 343/754 |

FOREIGN PATENT DOCUMENTS

| | | | |
|---|---|---|---|
| CN | 1031159 | A | 2/1989 |
| CN | 1336703 | A | 2/2002 |
| JP | 62-89821 | A | 6/1987 |
| JP | 3-157006 | A | 7/1991 |
| JP | 8-167812 | A | 6/1996 |
| JP | 2765556 | B | 6/1998 |
| JP | 11-88044 | A | 3/1999 |
| JP | 11-191707 | A | 7/1999 |
| JP | 2002057524 | A | 2/2002 |
| JP | 2003309426 | A | 10/2003 |
| JP | 2003347836 | A | 12/2003 |
| JP | 2005136542 | A | 5/2005 |
| JP | 2005303801 | A | 10/2005 |
| JP | 2007259047 | A | 10/2007 |

OTHER PUBLICATIONS

International Search Report for PCT/JP2009/071311 mailed Apr. 6, 2010.
Chinese Office Action for CN Application No. 200980155958.5 issued on Jun. 13, 2013 with English Translation.

* cited by examiner

*Primary Examiner* — Karl D Frech

(57) ABSTRACT

An array antenna includes: a plurality of first antenna elements arrayed at specified element intervals on a plane of a board; a plurality of second antenna elements arrayed at the element intervals in parallel to an array direction of the first antenna elements on the plane; a first power supply circuit for supplying electric power to the respective first antenna elements by a line branched at a first branch point on the plane; and a second power supply circuit for supplying electric power to the respective second antenna elements by a line branched at a second branch point shifted by a specified distance in the array direction with respect to the first branch point on the plane.

6 Claims, 11 Drawing Sheets

ARRAY ANTENNA AND METHOD FOR MANUFACUTRING ARRAY ANTENNA

This application is the National Phase of PCT/JP2009/071311, filed Dec. 22, 2009, which is based upon and claims the benefit of priority from Japanese patent application No. 2009-025232, filed on Feb. 5, 2009, the disclosure of which is incorporated herein in its entirety by reference.

TECHNICAL FIELD

The present invention relates to a technology for improving the side lobe characteristics of an array antenna

BACKGROUND ART

In a radio system such as a point to point system, for example, a parabolic antenna and an array antenna are used.

As shown in FIG. 1, a general array antenna is constructed of a plurality of antenna elements provided on a printed board and a power supply circuit for supplying electric power to these antenna elements. Circles in the drawing designate the antenna elements, and solid lines to connect the respective antenna elements designate lines constructing the power supply circuit (microstrip lines). As shown in the drawing, the antenna elements are arrayed in the shape of a grid on the printed board.

In the array antenna constructed in this way, unnecessary radiation (grading lobe) will be generated in a direction different from a direction in which radiation is maximum (main lobe direction). When this radiation is large, side lobe characteristics will be degraded.

In the drawing, it is assumed that an X-Y plane including an X axis and a Y axis is parallel to the plane of paper and that a Z axis is in a direction vertical to the X-Y plane. It is assumed that this Z axis is a main lobe direction. All of the antenna elements and the lines of the power supply circuits are provided on the printed board on the X-Y plane. Moreover, the antenna elements are arranged in a row in the X axis direction and a plurality of rows are arranged side by side in the Y axis direction. It is assumed that this X axis direction is an array direction in which the antenna elements are arrayed.

Let's consider a case in which, as shown in FIG. 2, the antenna elements are arrayed at element intervals d on the plane of the board. In the drawing, it is assumed that an X-Z plane including the X axis and the Z axis is parallel to the plane of the paper and that the Y axis is in a direction vertical to the X-Z plane.

Here, in a case where the element interval d is longer than a half wavelength of a radiation wave, an unnecessary radiation beam will be generated in addition to a main beam in the main lobe direction (Z axis direction). Specifically, unnecessary radiation will be generated in a $\theta_n$ direction to satisfy the following equation (1).

$$\sin\theta_n=\sin\theta_o+n\lambda/d \quad (1)$$

where in the equation (1), $\theta_o$ is the direction of the main beam (main lobe), $\theta_n$ is the direction of unnecessary radiation, n is a natural number, and d is the element interval (interval of a wave source of unnecessary radiation).

For example, in a case where n=1, $\theta_o$=0, and d=1.4×λ, $\theta_n$ can be calculated by the equation (2).

$$\theta_n=\arcsin(1/1.4)=45(\text{deg}) \quad (2)$$

That is, in this case, unnecessary radiation will be generated in a direction of 45 degrees when viewed from the main lobe direction.

In FIG. 2, a case will be shown as an example where an antenna element itself is a wave source of the unnecessary radiation. However, also a branch point of the microstrip line can be a wave source of the unnecessary radiation. Arrows in FIG. 1 show the wave sources of the unnecessary radiation. In the drawing, the unnecessary radiation is generated at a branch point between the adjacent antenna elements. The direction of the arrow of unnecessary radiation designates the direction of an electric field and is the same direction of a polarized wave of the element of the antenna (omitted in the drawing).

The side lobe characteristics of the array antenna will be degraded by the generation of unnecessary radiation.

Specifically, FIG. 3 is a view to show a radiation pattern of an array antenna in which the unnecessary radiation of the microstrip line is reduced. FIG. 4 is a view to show a radiation pattern of an array antenna which is affected by unnecessary radiation of the microstrip line. In FIG. 3 and FIG. 4, a vertical axis indicates a gain (dB) and a horizontal axis indicates an angle made by a main lobe direction and the direction of a radiation wave.

As shown in FIG. 3, the maximum value of a side lobe level in a case in which unnecessary radiation of the microstrip wiring is not generated is −31.8 dB, whereas the maximum value of a side lobe level in a case in which unnecessary radiation of the microstrip line is generated is −21.6 dB as shown in FIG. 4. In this way, unnecessary radiation of the microstrip line has a significant effect on the side lobe characteristics of the array antenna.

In general, in a radio system, an antenna having excellent side lobe characteristics is required in many cases so as to suppress unnecessary radiation to the surroundings.

Thus, in a general array antenna, a power supply circuit may be provided on a board different from a printed board on which antenna elements are provided. According to this construction, unnecessary radiation generated at the branch point of the microstrip line does not have an effect on a plane on which the antenna elements are provided and hence the side low characteristics of the array antenna can be improved. Furthermore, in an array antenna described in a patent document 1, unnecessary radiation from the power supply circuit is reduced by providing a shield plate on a circuit on which a power supply circuit is provided.

PRIOR ART LITERATURE

Patent Document

Patent document 1: Japanese Unexamined Patent Publication No. Hei 8-167812

SUMMARY OF THE INVENTION

Problems that the Invention is to Solve

However, the array antenna described in the patent document 1 presents the following problems: that is, a plurality of printed boards need to be prepared to make a construction of an array antenna complex, which makes it impossible to manufacture the array antenna at a low cost (increases manufacturing cost of the array antenna).

The object of the present is to provide a technology for reducing unnecessary radiation of an array antenna by a simple construction.

Means for Solving the Problems

In order to achieve the above object, an array antenna of the present invention includes: a plurality of first antenna elements arrayed at specified element intervals on a plane of a board; a plurality of second antenna elements arrayed at the element intervals in parallel to an array direction of the first antenna elements on the plane; a first power supply circuit for supplying electric power to the respective first antenna elements by a line branched at a first branch point on the plane; and a second power supply circuit for supplying electric power to the respective second antenna elements by a line branched at a second branch point shifted by a specified distance in the array direction with respect to the first branch point on the plane.

A method of manufacturing an array antenna of the present invention is a method of manufacturing an array antenna, the method including the steps of arraying a plurality of first antenna elements of specified element intervals on a plane of a board; arraying a plurality of second antenna elements at the element intervals in parallel to an array direction of the first antenna elements on the plane; providing a first power supply circuit for supplying electric power to the respective first antenna elements by a line branched at a first branch point on the plane; and providing a second power supply circuit for supplying electric power to the respective second antenna elements by a line branched at a second branch point shifted by a specified distance in the array direction with respect to the first branch point on the plane.

Effect of the Invention

According to the present invention, the branch point of the line for supplying electric power to the second antenna elements is shifted by the specified distance in the array direction with respect to the branch point of the line for supplying electric power to the first antenna element. As a result, the intervals in the array direction of the branch points at which unnecessary radiation is generated become narrow, which results in reducing unnecessary radiation of the entire of the array antenna.

MODE FOR CARRYING OUT THE INVENTION (First Embodiment)

A first embodiment for carrying out the present invention will be described in detail with reference to the drawings.

Figure 5:
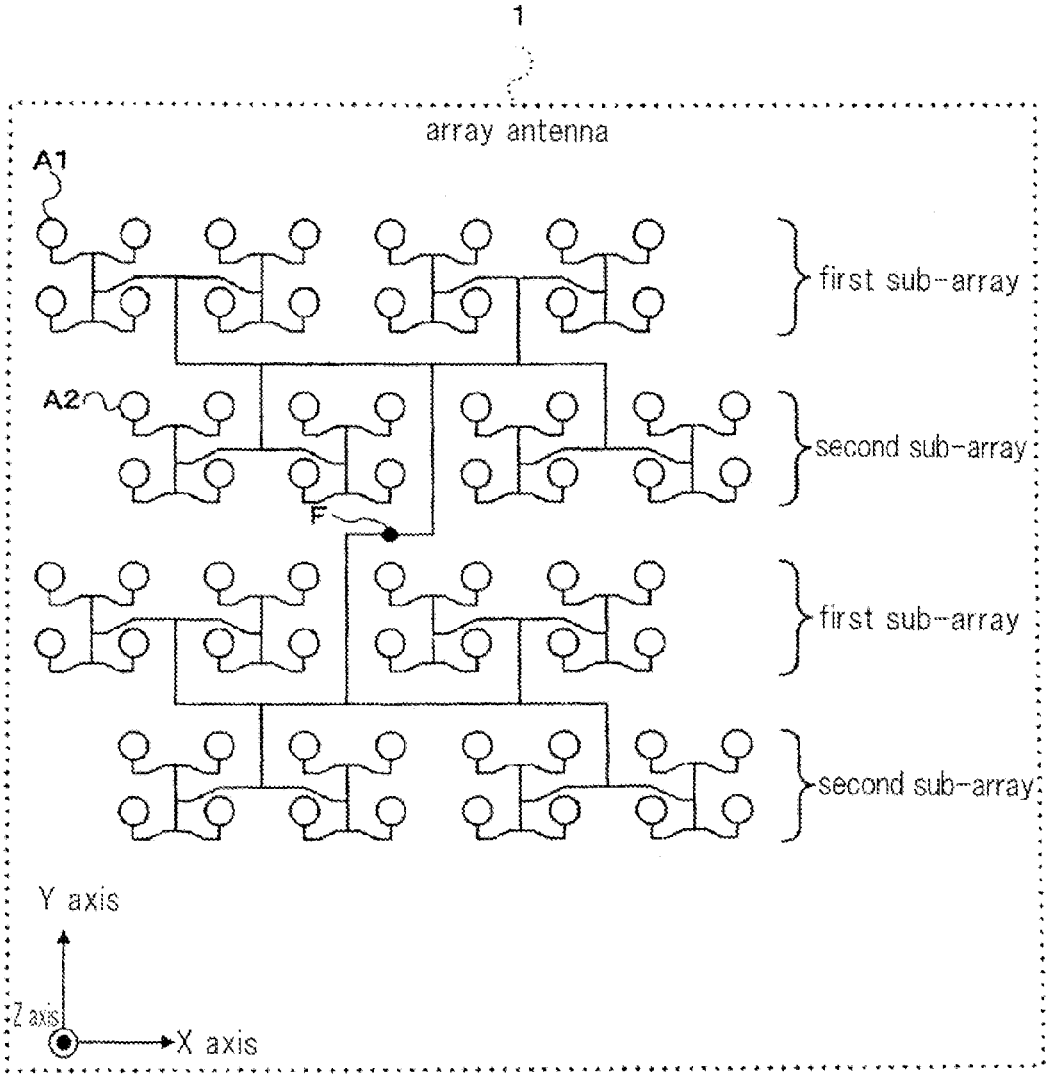
FIG. 5 is a circuit diagram to show a construction of an array antenna of a first embodiment of the present invention.

FIG. 5 is a circuit diagram to show a construction of an array antenna 1 of the present embodiment. Referring to the drawing, the array antenna 1 has a plurality of antenna elements such as A1, A2 and a plurality of power supply circuits.

In the drawing, it is assumed that an X-Y plane including an X axis and a Y axis is parallel to a plane of paper and that a Z axis is in a direction vertical to this X-Y plane. All of the antenna elements and the lines of the power supply circuits are provided on a printed board on the X-Y plane. For example, it is assumed that the direction of this Z axis is the main lobe direction of the array antenna 1.

As to the printed board, a board made of a material of PTFE (Polytetrafluoroethylene) is suitable because the material is of low loss, but also a material such as BT (Bismaleimide-Triazine) resin and PPE (Poly Phenylene Ether) can be employed for the purpose of reducing cost relating to the material.

All of the antenna elements (A1 and the like) have the same characteristics. The antenna elements are arranged in a row in the direction of the X axis and a plurality of rows are arranged side by side in the direction of the Y axis. Hereinafter, the direction of the X axis is referred to as an array direction.

The power supply circuit has a power source (not shown) connected to a point F in FIG. 5 and microstrip lines plurally branched from the point F and connected to the respective antenna elements. Solids lines in the drawing designate the wirings of the microstrip lines.

The respective antenna elements are classified into two groups according to the position of the branch point of the power supply line. Each of the groups is constructed of the plurality of antenna elements arrayed in two rows. Hereinafter, one part including the antenna elements belonging to one group and the microstrip lines connected to these antenna elements (first power supply circuit) is referred to as a first sub-array, and the other part including the antenna elements belonging to the other group and the microstrip lines connected to these antenna elements (second power supply circuit) is referred to as a second sub-array.

Figure 6:
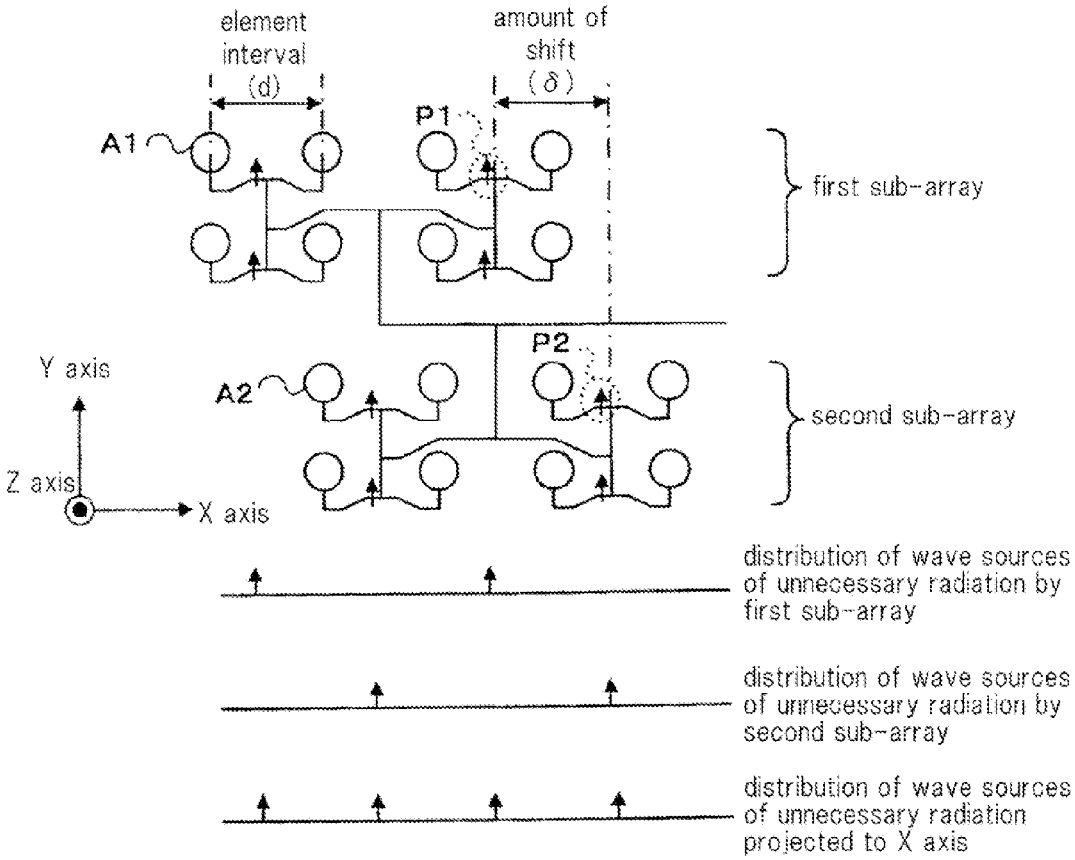
FIG. 6 is a view to show the positions of wave sources of unnecessary radiation of the array antenna of the first embodiment of the present invention.

FIG. 6 is a circuit diagram to show the positions of wave sources of unnecessary radiation generated by array antenna 1. Arrows in the drawing show the wave sources of unnecessary radiation. As shown in the drawing, the respective antenna elements are arrayed at specified element intervals (d).

Here, the element interval is a distance between the centers of the adjacent antenna elements. In other words, the element interval is a difference between the X coordinates of the centers of the adjacent antenna elements.

Further, as shown in FIG. 6, the microstrip lines are branched at branch points such as P1 and P2. Unnecessary radiation is generated at these branch points. As shown in the drawing, for example, at the branch point between the adjacent antenna elements, unnecessary radiation is generated in a direction shown by the arrow (direction of the Y axis). Unnecessary radiation is generated also at the branch points not shown by arrows, but the directions of unnecessary radiation at these branch points are different from each other. When considering the effects of all unnecessary radiation, the description will become complex and hence unnecessary radiation generated at the branch points not shown by the arrows will be omitted for convenience of description.

The microstrip lines are wired in such a way that the positions of the branch points such as P1 of the microstrip line in the first sub-array are shifted by δ (amount of shift) in the array direction (direction of the X axis) with respect to the positions of the branch points such as P2 of the microstrip line in the second sub-array.

In the other words, the power supply circuits are wired in such a way that the differences between the X coordinates of the branch points (such as P1) in the first sub-array and the X coordinates of the branch points (such as P2) in the second sub-array become δ.

When the wave sources (such as P1) of unnecessary radiation of the first sub-array and the wave sources (such as P2) of unnecessary radiation of the second sub-array are projected to the X axis, the intervals of these wave sources of unnecessary radiation are made narrower than those before the shift. Hence, unnecessary radiation does not intensify each other in the distance, which results in preventing the side lobe characteristics from being degraded.

For example, when it is assumed that the interval d of the wave sources of unnecessary radiation before the shift is 1.4×wavelength and that an angle $\theta_0$, which is formed by the direction of the main lobe and the Z axis, =0 and that n=1, from the above equation (1), an angle $\theta_n$, which is formed by the direction of grading lobe on the X-Z plane and the main lobe direction (Z axis), =45 degrees. That is, on the X-Z plane, the grading lobe will be generated in a direction which makes an angle of 45 degrees with the Z axis.

However, by shifting the branch points such as P1 of the microstrip line in the first sub-array in the X axis direction, when it is assumed that the interval of the wave sources of unnecessary radiation is 0.7×wavelength, the right side of the equation (1) becomes larger than 1, and hence in the X-Z plane, a direction ($\theta_n$) in which the grading lobe is generated, does not exist. In this way, by narrowing the interval in the X axis direction of the wave sources of unnecessary radiation, generation of the grading lobe in the X-Z plane is suppressed and hence the side lobe characteristics of the entire array antenna can be improved.

Figure 1:
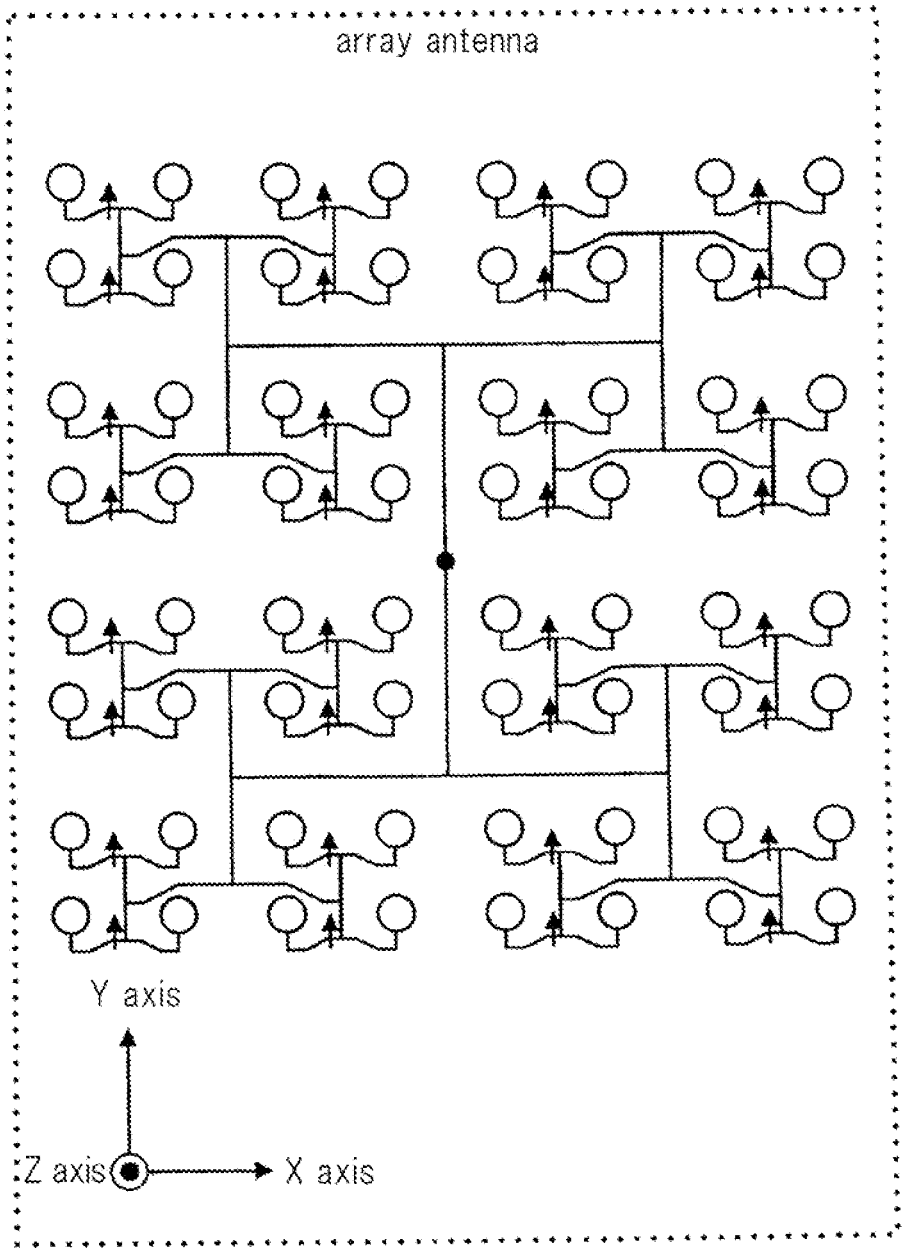
FIG. 1 is a circuit diagram to show a construction of a general array antenna.
Figure 2:
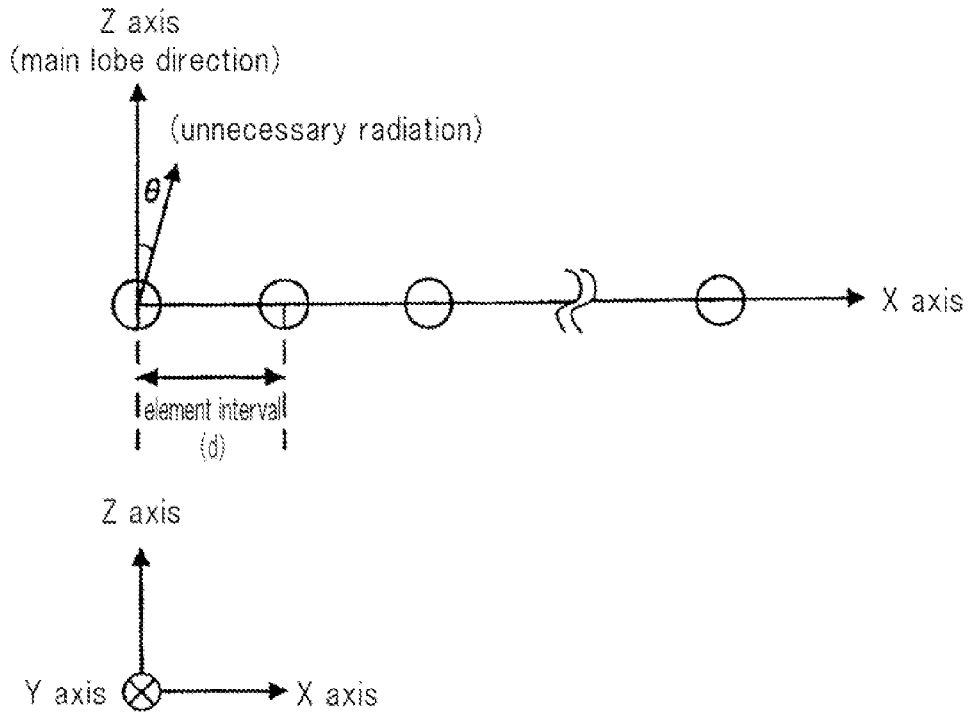
FIG. 2 is a view to illustrate unnecessary radiation in a general array antenna.
Figure 3:
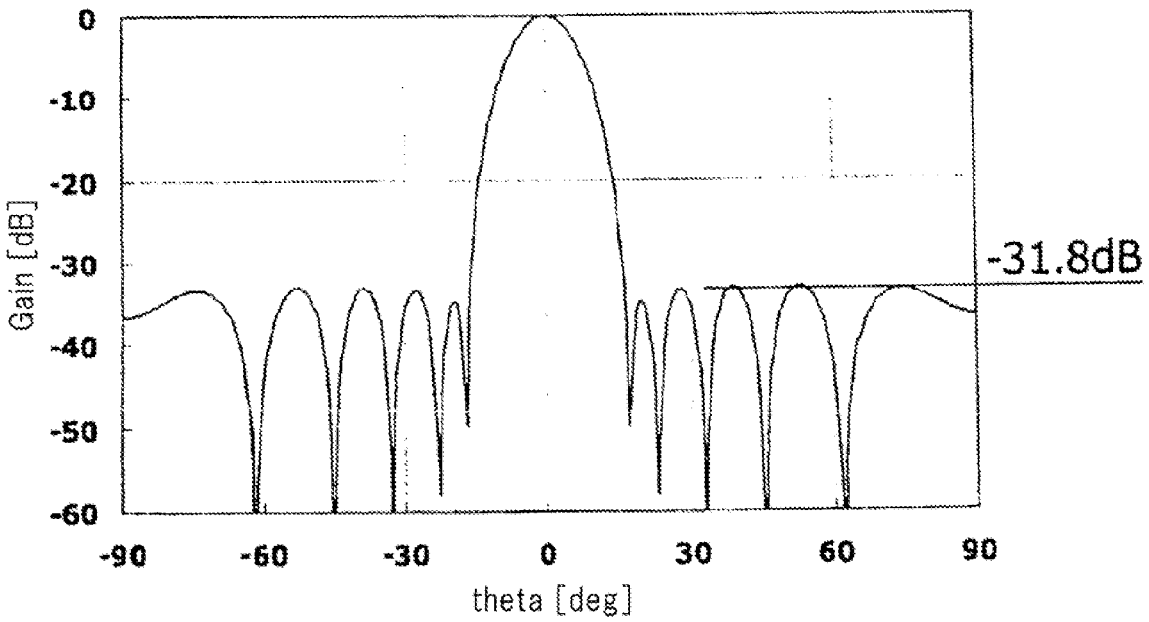
FIG. 3 is a view to show a radiation pattern of a general array antenna.
Figure 4:
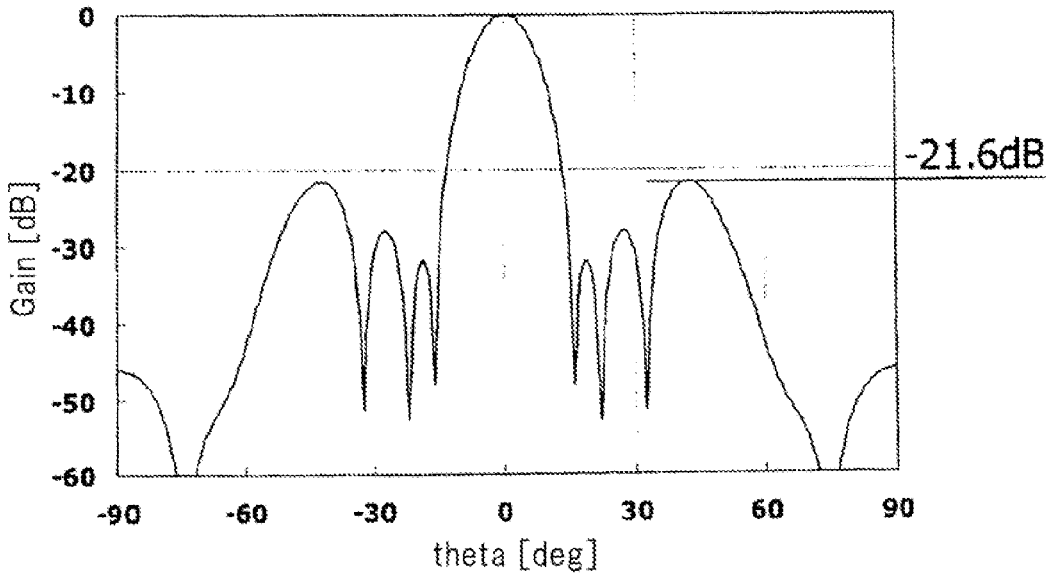
FIG. 4 is a view to show a radiation pattern of a general array antenna.
Figure 7:
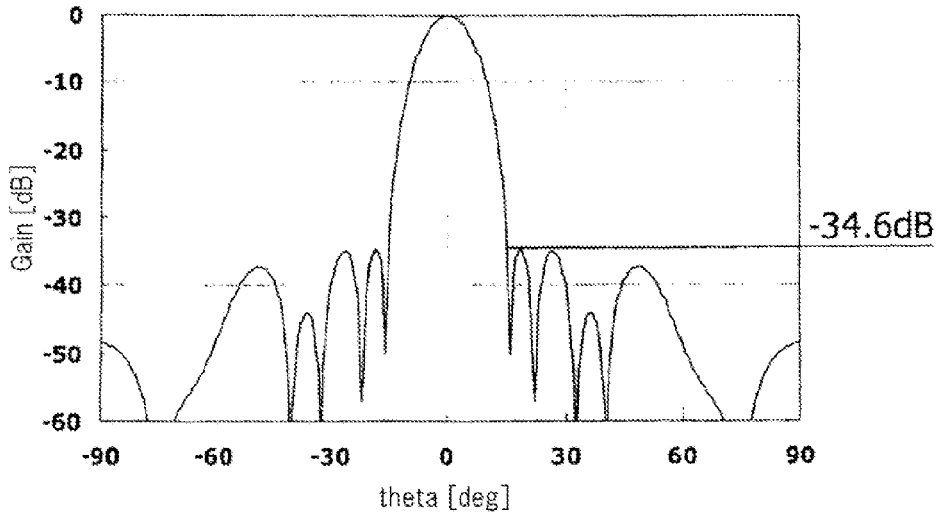
FIG. 7 is a view to show a radiation pattern of the array antenna of the first embodiment of the present invention.

FIG. 7 is a view to show a radiation pattern of array antenna 1 of the present embodiment. A vertical axis in the drawing indicates the gain (dB) of array antenna 1 and a horizontal axis indicates an angle (θ) in an observation direction with respect to the main lobe direction. As shown in the drawing, the maximum gain of array antenna 1 of the present embodiment is −34.6 dB, whereas the maximum gain in the general array antenna shown in FIG. 4 is −21.6 dB.

In this way, the side lobe characteristics of array antenna 1 in which the sub-array is shifted in the array direction (X axis direction) become better than those of the array antenna in which the sub-array is not shifted.

In this regard, the present embodiment is constructed in such a way that the sub-arrays are shifted every two rows. However, needless to say, it is also possible to employ a construction in which the sub-arrays are shifted every plural rows of three rows or more.

Moreover, in the present embodiment, the shape of the antenna element is described to be circular in FIG. 5 and the like, but the shape of the antenna element can be made an arbitrary shape such as a square.

Further, each of the antenna elements can also have a parasitic element fixed thereto. When the antenna element has the parasitic element fixed thereto, for example, a structure described in Japanese Patent Number No. 2765556 is employed.

Figure 8:
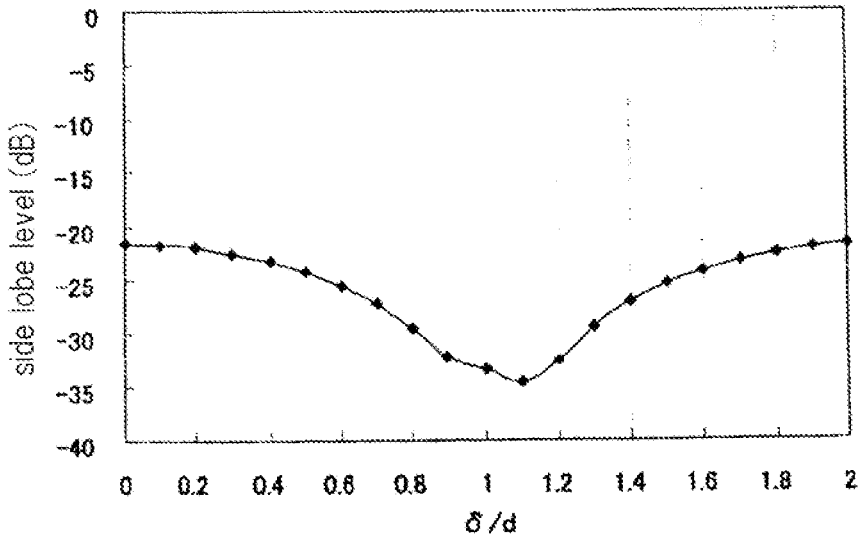
FIG. 8 is a graph to show the side lobe characteristics of the array antenna of the first embodiment of the present invention.

FIG. 8 is a graph to show the result of measurement of the side lobe characteristics of array antenna 1 for various values of the amount of shift. A vertical axis in the drawing indicates a side lobe level (dB) and a horizontal axis indicates the ratio of the amount of shift (8) to the element interval (d). Referring to the drawing, it is practically desired to employ a construction in which the value of δ/d ranges from 0.4 to 1.1. Furthermore, it is when the value of δ/d is 1.1 that the side lobe level becomes minimum.

As described above, according to the present embodiment, the branch points (such as P2) of the microstrip lines to supply electric power to the second antenna elements (such as A2) are shifted by a specified distance (the amount of shift: δ) in the array direction (X axis direction) with respect to the branch points (such as P1) of the microstrip lines to supply electric power to the first antenna elements (such as A1), so that the branch points in which unnecessary radiation is generated are shifted from each other to narrow the intervals in the array direction of the branch points. As a result, the side lobe characteristics of the entire array antenna 1 can be improved.

Moreover, by making the amount of shift (δ) nearly equal to (for example, 1.1 times) the element interval (d), the side lobe characteristics of array antenna 1 can be made best.

(Second Embodiment)

Figure 9:
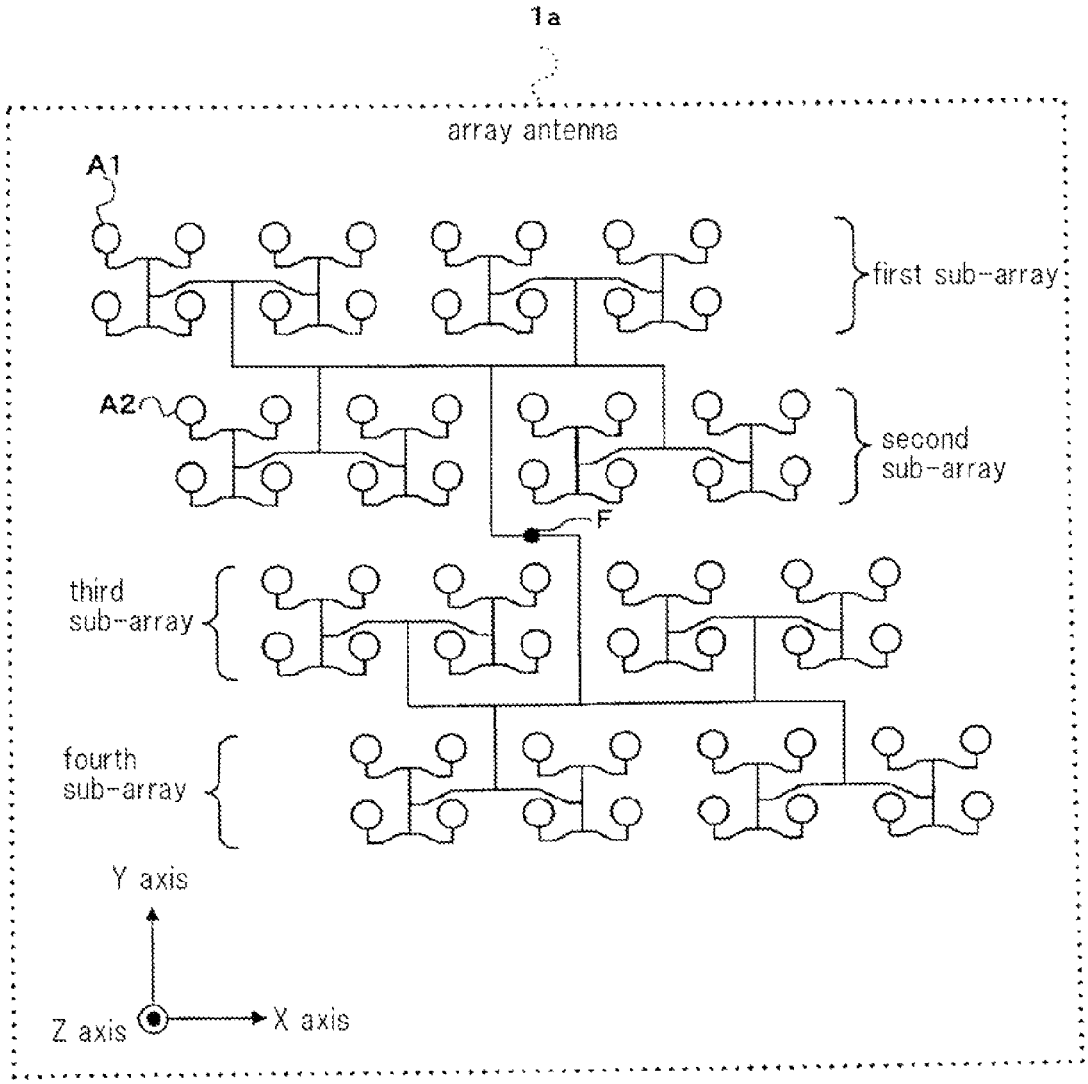
FIG. 9 is a circuit diagram to show a construction of an array antenna of a second embodiment of the present invention.

A second embodiment of the present invention will be described with reference to FIG. 9. The drawing is a circuit diagram to show the construction of array antenna 1*a* of the present embodiment. Referring to the drawing, the antenna elements and the microstrip lines of the present embodiment are classified into four groups (first to fourth sub-arrays).

When it is assumed that the amount of shift of the second sub-array with respect to the first sub-array is δ, the amount of shift of the third sub-array with respect to the first sub-array is two times the δ, and the amount of shift of the fourth sub-array with respect to the first sub-array is three times the δ.

When the amount of shift of the second sub-array with respect to the first sub-array is made equal to the amount of shift of the fourth sub-array with respect to the first sub-array, the X coordinates of the wave sources of unnecessary radiation in the second and the fourth sub-arrays are made coincident, which means that the wave sources of unnecessary radiation in the second and the fourth sub-arrays are not shifted from each other. However, in the present embodiment, the values of the amount of shift of the sub-arrays other than the first sub-array with respect to the fist sub-array are different from each other, so that the wave sources of unnecessary radiation in the respective sub-arrays are dispersed and hence the side lobe characteristics of array antenna 1*a* are further reduced.

(Third Embodiment)

Figure 10:
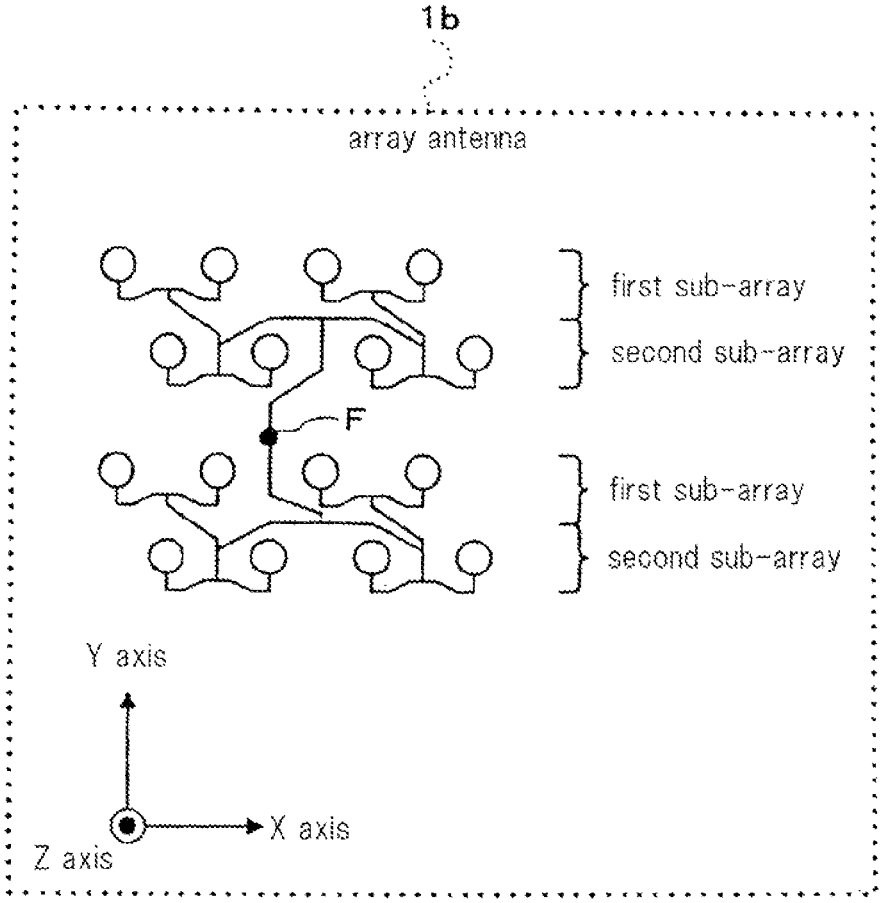
FIG. 10 is a circuit diagram to show a construction of an array antenna of a third embodiment of the present invention.

A third embodiment of the present invention will be described with reference to FIG. 10. The drawing is a circuit diagram to show the construction of array antenna 1*b* of the present embodiment. Referring to the drawing, in array antenna 1*b*, the sub-arrays are shifted in the array direction ever y one row.

When a construction in which the sub-arrays are shifted for every two rows as is the case of array antenna 1 of the first embodiment is used, the respective rows in the respective sub-arrays are not shifted. However, when a construction in which the sub-arrays are shifted every one row like the present embodiment is used, the wave sources of unnecessary radiation of the respective rows are dispersed and hence the side lobe characteristics are further reduced.

(Fourth Embodiment)

Figure 11:
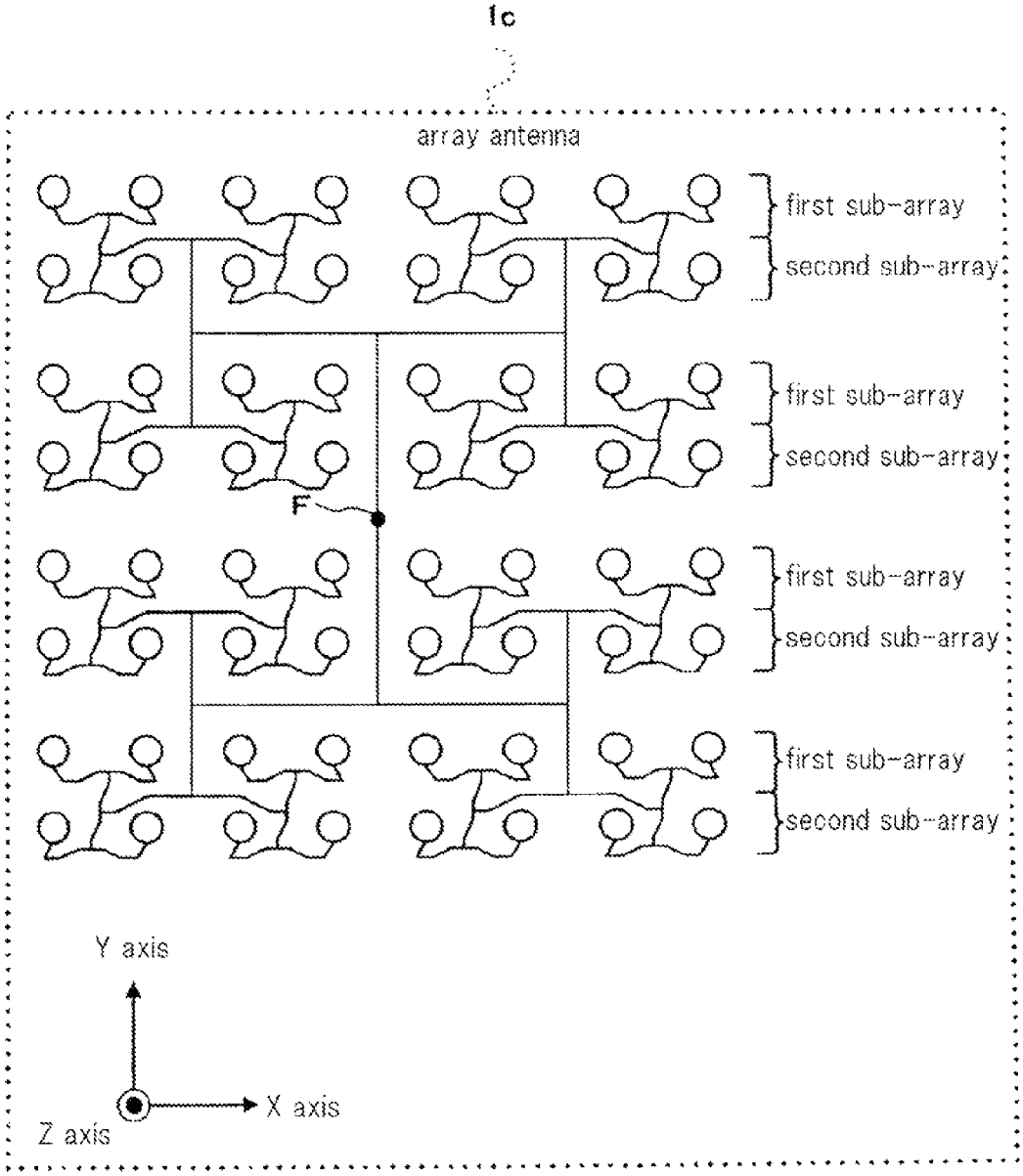
FIG. 11 is a circuit diagram to show a construction of an array antenna of a fourth embodiment of the present invention.

A fourth embodiment of the present invention will be described with reference to FIG. 11 to FIG. 13. FIG. 11 is a circuit diagram to show the construction of array antenna 1*c* of the present embodiment. Referring to the drawing, in array antenna 1*c*, the antenna elements of the respective sub-arrays are not shifted from each other, but only the branch points of the microstrip circuits are shifted every one row in the array direction.

Figure 12:
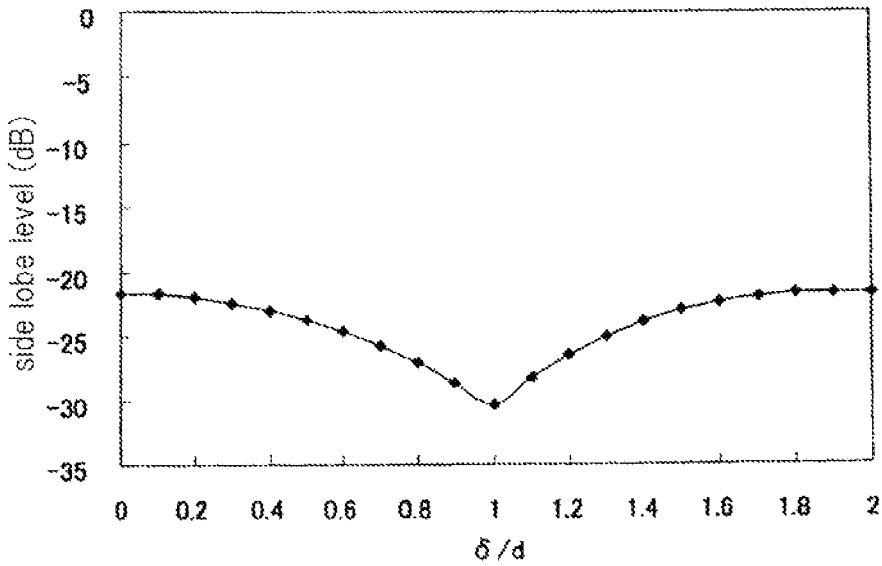
FIG. 12 is a graph to show the side lobe characteristics of the array antenna of the fourth embodiment of the present invention.
Figure 13:
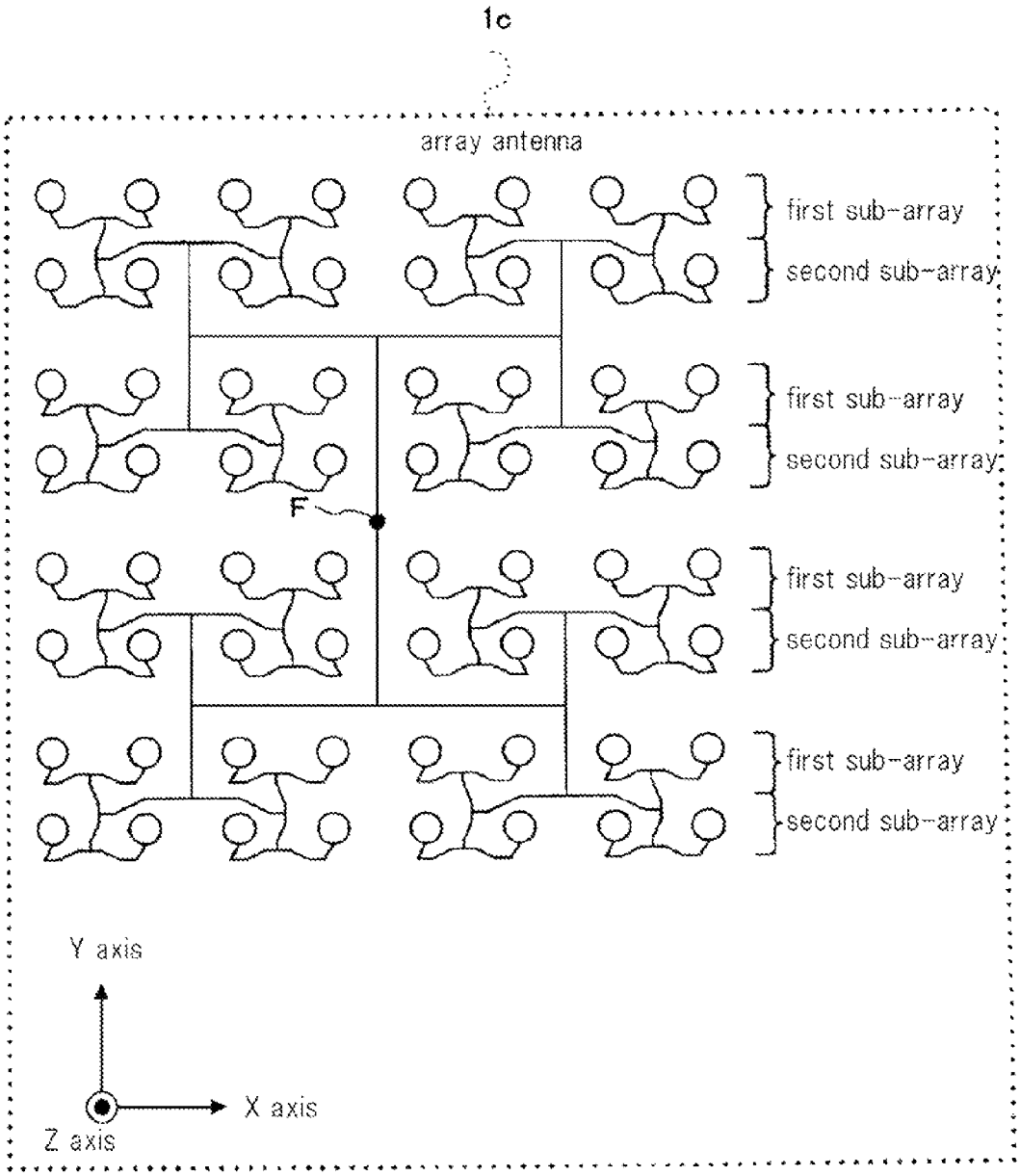
FIG. 13 is a circuit diagram to show a construction of an array antenna of a modification of the present invention.

FIG. 12 is a graph to show the result of measurement of the side lobe level of array antenna 1*c* for various values of the amount of shift. In the drawing, a vertical axis indicates a side lobe level (dB) and a horizontal axis indicates the ratio of the amount of shift (δ) to the element interval (d). Referring to the drawing, it is when the value of δ/d is 1.0 that the side lobe level becomes minimum.

In this regard, the present embodiment employs a construction in which only the branch points of the microstrip circuits are shifted every one row. However, needless to say, it is also possible to employ a construction in which the branch points of the microstrip circuits are shifted every plural row as shown in FIG. 13.

As described above, according to the present embodiment, while the branch points that can be the wave sources of unnecessary radiation are shifted from each other, the antenna elements are not shifted. For this reason, as compared with the first embodiment in which not only the branch points but also the antenna elements are shifted, according to the present embodiment, the side lobe characteristics of array antenna 1*c* can be reduced and the area of array antenna 1*c* can be reduced.

Furthermore, by making the amount of shift (δ) nearly equal to (for example, 1.0 times) the element interval (d), the side lobe characteristics can be made best.

DESCRIPTION OF REFERENCE NUMERALS AND SIGNS

1, 1*a*, 1*b*, 1*c* array antenna
A1, A2 antenna element
P1, P2 branch point

The invention claimed is:

1. An array antenna comprising:

a plurality of first antenna elements arrayed at specified element intervals on a plane of a board;

a plurality of second antenna elements arrayed at the element intervals and that are parallel to an array direction of the first antenna elements on the plane;

a first power supply circuit that supplies electric power to the respective first antenna elements by a line branched at a first branch point on the plane; and a second power supply circuit that supplies electric power to the respective second antenna elements by a line branched at a second branch point shifted by a specified distance in the array direction with respect to the first branch point on the plane, wherein said first antenna elements and said second antenna elements are shifted based on the specified distance in said array direction.

2. The array antenna according to claim 1, wherein a row of the first antenna elements and a row of the second antenna elements are arranged alternately in a direction vertical to the array direction in the plane, and wherein the first power supply circuit and the second power supply circuit are arranged alternately.

3. The array antenna according to claim 2, wherein the specified distance is nearly equal to the element interval.

4. The array antenna according to claim 1, wherein positions of the first antenna elements coincide with positions of the second antenna elements in the array direction.

5. An array antenna comprising:

a plurality of first antenna elements arrayed at specified element intervals on a plane of a board;

a plurality of second antenna elements arrayed at the element intervals and that are parallel to an array direction of the first antenna elements on the plane;

a first power supply circuit that supplies electric power to the respective first antenna elements by a line branched at a first branch point on the plane;

a second power supply circuit that supplies electric power to the respective second antenna elements by a line branched at a second branch point shifted by a specified distance in the array direction with respect to the first branch point on the plane;

a plurality of third antenna elements arrayed in parallel to the array direction on the plane; and a third power supply circuit that supplies electric power to the respective third antenna elements by a line branched at a third branch point shifted by two times the specified distance in the array direction with respect to the first branch point on the plane.

6. A method of manufacturing an array antenna, the method comprising the steps of:

arraying a plurality of first antenna elements at specified element intervals on a plane of a board;

arraying a plurality of second antenna elements at the element intervals and that are parallel to an array direction of the first antenna elements on the plane;

providing a first power supply circuit that supplies electric power to the respective first antenna elements by a line branched at a first branch point on the plane; and providing a second power supply circuit that supplies electric power to the respective second antenna elements by a line branched at a second branch point shifted by a specified distance in the array direction with respect to the first branch point on the plane, wherein said first antenna elements and said second antenna elements are formed to be shifted based on the specified distance in said array direction.

* * * * *